US010672353B2

(12) United States Patent
Kim et al.

(10) Patent No.: US 10,672,353 B2
(45) Date of Patent: Jun. 2, 2020

(54) DISPLAY DEVICE AND A METHOD FOR DRIVING THE SAME

(71) Applicant: SAMSUNG DISPLAY CO., LTD., Yongin-si, Gyeonggi-Do (KR)

(72) Inventors: Hongkyu Kim, Suwon-si (KR); Poyun Park, Seoul (KR); Yujin Kim, Suwon-si (KR); Jimyoung Seo, Hwaseong-si (KR); Gwangsoo Ahn, Suwon-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 163 days.

(21) Appl. No.: 15/691,190

(22) Filed: Aug. 30, 2017

(65) Prior Publication Data

US 2018/0061352 A1 Mar. 1, 2018

(30) Foreign Application Priority Data

Aug. 31, 2016 (KR) ..... 10-2016-0111282

(51) Int. Cl.
*G09G 3/36* (2006.01)

(52) U.S. Cl.
CPC ..... *G09G 3/3677* (2013.01); *G09G 3/3648* (2013.01); *G09G 3/3696* (2013.01); *G09G 2310/0289* (2013.01); *G09G 2310/08* (2013.01); *G09G 2320/0285* (2013.01); *G09G 2354/00* (2013.01)

(58) Field of Classification Search
None
See application file for complete search history.

(56) References Cited

U.S. PATENT DOCUMENTS

| | | | | |
|---|---|---|---|---|
| 7,342,561 | B2 | 3/2008 | Hiraki et al. | |
| 8,619,015 | B2 | 12/2013 | Hwang et al. | |
| 2004/0095342 | A1* | 5/2004 | Lee | G09G 3/3696 345/211 |
| 2010/0053146 | A1* | 3/2010 | Han | G09G 3/2096 345/214 |
| 2010/0066708 | A1* | 3/2010 | Kim | G09G 3/3614 345/204 |
| 2012/0169686 | A1* | 7/2012 | Kim | G09G 3/2096 345/208 |
| 2012/0169698 | A1* | 7/2012 | Park | G09G 3/20 345/211 |
| 2013/0002641 | A1* | 1/2013 | Kim | G09G 3/3685 345/212 |
| 2017/0263207 | A1* | 9/2017 | Iwami | G09G 3/2096 |

FOREIGN PATENT DOCUMENTS

| | | |
|---|---|---|
| KR | 10-0832209 | 5/2008 |
| KR | 10-1384283 | 4/2014 |
| KR | 10-1528927 | 6/2015 |

* cited by examiner

*Primary Examiner* — Kent W Chang
*Assistant Examiner* — Benjamin Morales
(74) *Attorney, Agent, or Firm* — F. Chau & Associates, LLC

(57) ABSTRACT

A method of driving a display device includes receiving a reference clock signal and frequency determination data to determine a pixel driving clock frequency and generate a pixel driving clock signal, generating and outputting a gate driving clock signal according to the pixel driving clock frequency, and outputting a driving voltage according to the pixel driving clock frequency. The driving voltage increases as the pixel driving clock frequency increases.

20 Claims, 6 Drawing Sheets

DISPLAY DEVICE AND A METHOD FOR DRIVING THE SAME

CROSS-REFERENCE TO RELATED APPLICATION

This application claims priority under 35 U.S.C. § 119 to Korean Patent Application No. 10-2016-0111282, filed on Aug. 31, 2016 in the Korean Intellectual Property Office (KIPO), the disclosure of which is incorporated by reference herein in its entirety.

TECHNICAL FIELD

Exemplary embodiments of the inventive concept relate to a method of driving a display device, and more particularly, to a method of driving a display device driven at a varying frequency.

DISCUSSION OF RELATED ART

Display devices may be classified into liquid crystal display ("LCD") devices, organic light emitting diode ("OLED") display devices, plasma display panel ("PDP") devices, electrophoretic display devices, or the like based on a light emitting scheme thereof.

LCD devices, which are one of the most widely used flat panel display ("FPD") devices, include two substrates on which electrodes are formed and a liquid crystal layer interposed therebetween. LCD devices are display devices that may adjust an amount of transmitted light by applying voltage to two electrodes to rearrange liquid crystal molecules of the liquid crystal layer.

An LCD device may be driven at different frequencies. As such, a gate signal may be output abnormally. In addition, when the LCD device is driven at different frequencies, a charging rate of a pixel electrode may vary depending on the frequency.

SUMMARY

According to an exemplary embodiment of the inventive concept, a method of driving a display device includes receiving a reference clock signal and frequency determination data to determine a pixel driving clock frequency and generate a pixel driving clock signal, generating and outputting a gate driving clock signal according to the pixel driving clock frequency, and outputting a driving voltage according to the pixel driving clock frequency. The driving voltage increases as the pixel driving clock frequency increases.

The driving voltage may be at least one of a gate-on voltage and a data voltage.

Generating and outputting the gate driving clock signal may include selecting a gate driving clock generation datum according to the pixel driving clock frequency and generating and outputting the gate driving clock signal according to the gate driving clock generation datum.

The gate driving clock generation datum may be changeable by a user.

The frequency determination data may include a first frequency determination datum and a second frequency determination datum.

Receiving the reference clock signal and the frequency determination data to determine the pixel driving clock frequency and generate the pixel driving clock signal may further include calculating the pixel driving clock frequency.

The pixel driving clock frequency may satisfy the following Equation 1.

$$PFREQ = \frac{FDATA1}{FDATA2} \times RFREQ \quad \text{[Equation 1]}$$

PFREQ is the pixel driving clock frequency, FDATA1 is the first frequency determination datum, FDATA2 is the second frequency determination datum, and RFREQ is a frequency of the reference clock signal.

The gate driving clock signal may have a frequency different from a frequency of the reference clock signal.

According to an exemplary embodiment of the inventive concept, a display device includes a display panel, a timing controller, a clock generator, a data driver, a gate driver, and a voltage generator. The timing controller receives a reference clock signal, frequency determination data, and an input image data signal and outputs a driving voltage generation signal, a gate driving clock signal, and an image data signal. The clock generator receives the gate driving clock signal to output a converted gate driving clock signal. The data driver receives the image data signal from the timing controller to output a data signal. The gate driver receives the converted gate driving clock signal to output a gate signal. The voltage generator receives the driving voltage generation signal to output a driving voltage.

The timing controller may determine a pixel driving clock frequency using the reference clock signal and the frequency determination data.

The pixel driving clock frequency may satisfy the following Equation 1.

$$PFREQ = \frac{FDATA1}{FDATA2} \times RFREQ \quad \text{[Equation 1]}$$

PFREQ is the pixel driving clock frequency, FDATA1 is a first frequency determination datum of the frequency determination data, FDATA2 is a second frequency determination datum of the frequency determination data, and RFREQ is a frequency of the reference clock signal.

The driving voltage generation signal may be one of a gate-on voltage generation signal and a data voltage generation signal.

The driving voltage may be one of a gate-on voltage and a data voltage.

The gate-on voltage and the data voltage may increase as the pixel driving clock frequency increases.

According to an exemplary embodiment of the inventive concept, a display device includes a display panel, a timing controller, a voltage generator, a clock generator, a data driver, and a gate driver. The timing controller is configured to receive a reference clock signal and frequency determination data, determine a pixel driving clock frequency using the reference clock signal and the frequency determination data, and output a driving voltage generation signal and a gate driving clock signal corresponding to the pixel driving clock frequency. The voltage generator is configured to receive the driving voltage generation signal to output a gate-on voltage and a data voltage. The clock generator is configured to receive the gate driving clock signal and the gate-on voltage to output a converted gate driving clock signal. The data driver is configured to receive the data voltage and output a data signal to the display panel. The gate driver is configured to receive the converted gate driving clock signal and gate-on voltage, and output a gate signal to the display panel. As the pixel driving clock frequency increases, at least one of the gate-on voltage and the data voltage increases.

The timing controller may include a frequency determination unit configured to receive the reference clock signal and the frequency determination data and determine the pixel driving clock frequency. The pixel driving clock frequency satisfies the following Equation 1:

$$PFREQ = \frac{FDATA1}{FDATA2} \times RFREQ, \quad \text{[Equation 1]}$$

PFREQ is the pixel driving clock frequency, FDATA1 is a first frequency determination datum of the frequency determination data, FDATA2 is a second frequency determination datum of the frequency determination data, and RFREQ is a frequency of the reference clock signal.

The timing controller may include a driving voltage generation signal output unit including a lookup table. The driving voltage generation signal output unit may select the driving voltage generation signal corresponding to the pixel driving clock frequency using the lookup table.

The driving voltage generation signal may be one of a gate-on voltage generation signal and a data voltage generation signal. The voltage generator may adjust the gate-on voltage when the driving voltage generation signal is the gate-on voltage generation signal. The voltage generator may adjust the data voltage when the driving voltage generation signal is the data voltage generation signal.

The voltage generator may include one of a pulse width modulator or a pulse frequency modulator to adjust the gate-on voltage or the data voltage.

The converted gate driving clock signal may be a signal reflecting the gate-on voltage on the gate driving clock signal.

BRIEF DESCRIPTION OF THE DRAWINGS

The above and other features of the inventive concept will become more apparent by describing in detail exemplary embodiments thereof with reference to the accompanying drawings.

DETAILED DESCRIPTION OF THE EMBODIMENTS

Figure 1:
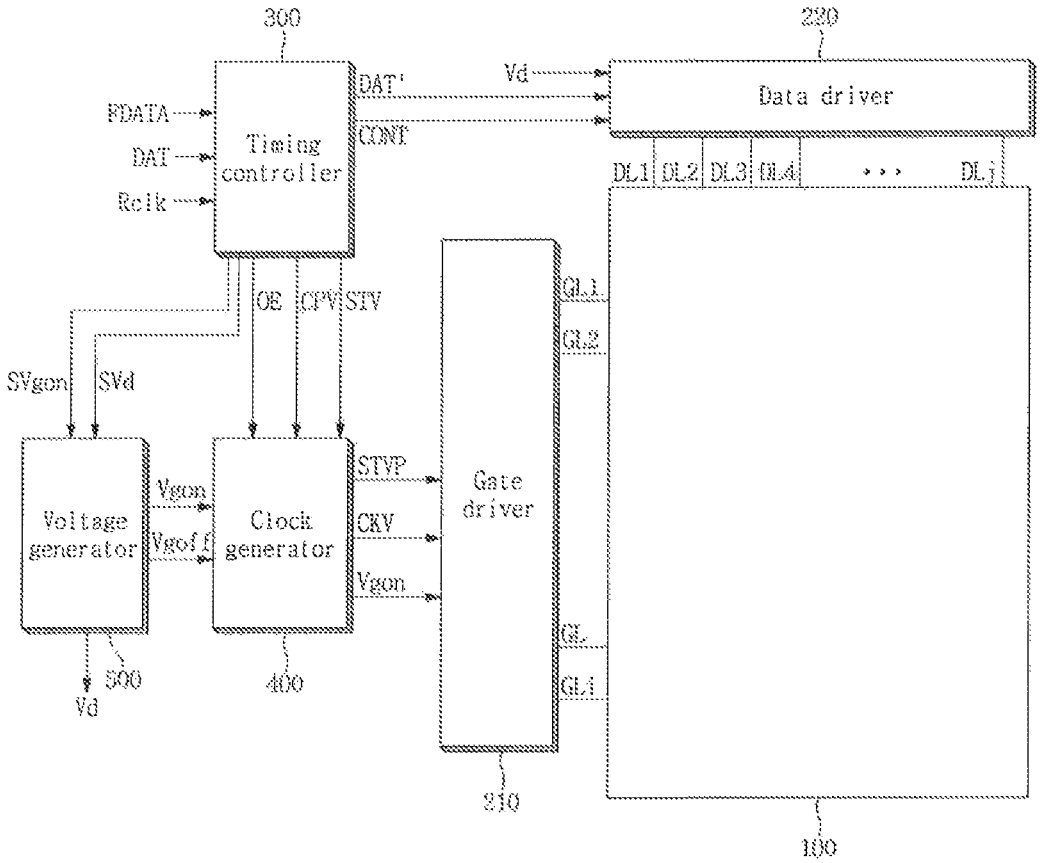
FIG. 1 is a block diagram illustrating a liquid crystal display (LCD) device according to an exemplary embodiment of the inventive concept.

Exemplary embodiments of the inventive concept may be directed to a method of driving a liquid crystal display (LCD) device capable of normally outputting a gate signal and compensating for a charging rate of a pixel electrode even when a frequency for driving the LCD device is changed.

Exemplary embodiments of the inventive concept will now be described more fully hereinafter with reference to the accompanying drawings. Like reference numerals may refer to like elements throughout this application.

Throughout the specification, when an element is referred to as being "connected" to another element, the element is "directly connected" to the other element, or "electrically connected" to the other element with one or more intervening elements interposed therebetween. It will be further understood that the terms "comprises," "including," "includes," and/or "including," when used in this specification, specify the presence of stated features, integers, steps, operations, elements, and/or components, but do not preclude the presence or addition of one or more other features, integers, steps, operations, elements, components, and/or groups thereof.

It will be understood that, although the terms "first," "second," "third," and the like may be used herein to describe various elements, these elements should not be limited by these terms. These terms are only used to distinguish one element from another element. Thus, "a first element" discussed below could be termed "a second element" or "a third element," and "a second element" and "a third element" may be termed likewise without departing from the teachings herein.

Figure 2:
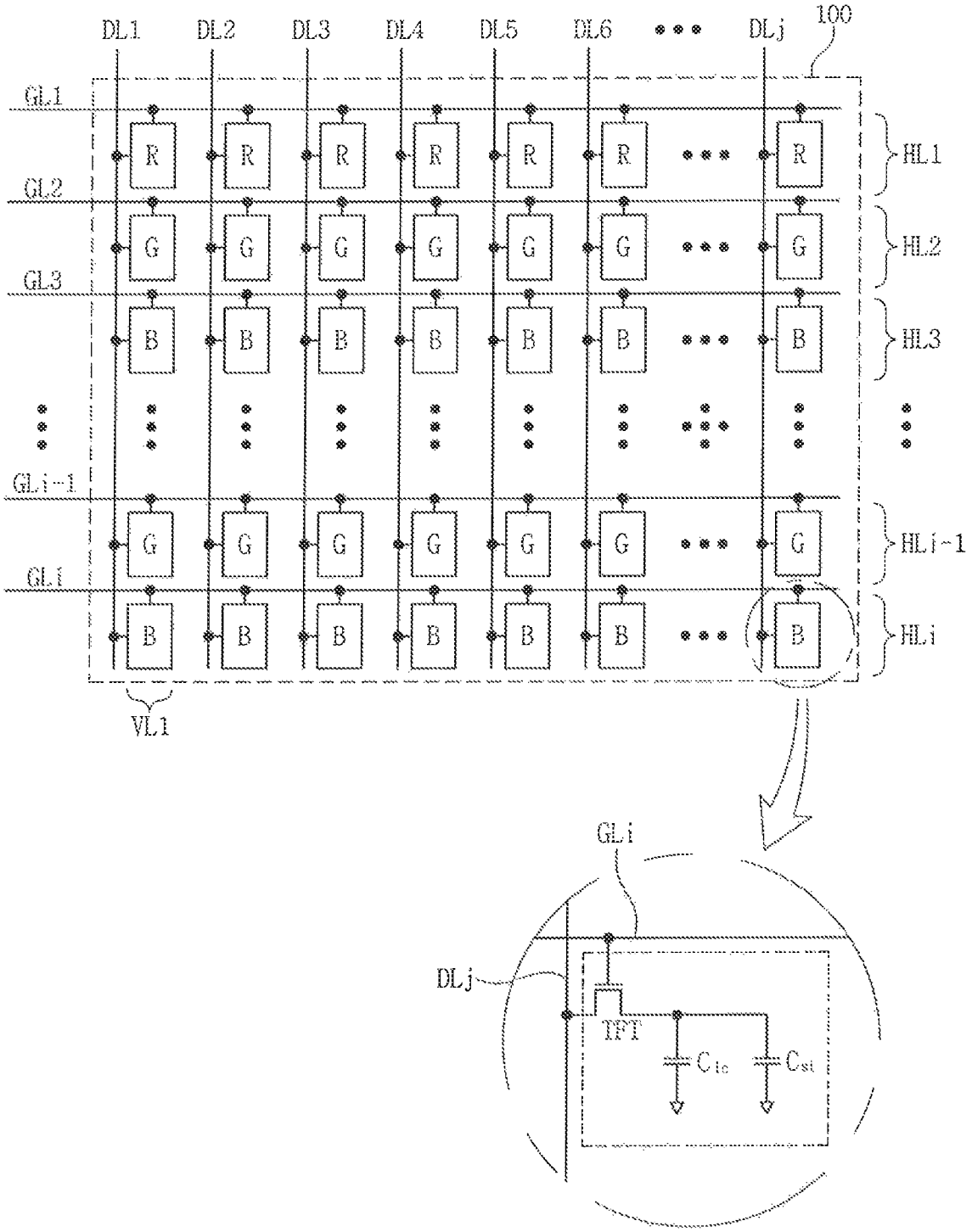
FIG. 2 is a view schematically illustrating pixels included in a display panel of FIG. 1 according to an exemplary embodiment of the inventive concept.
Figure 3:
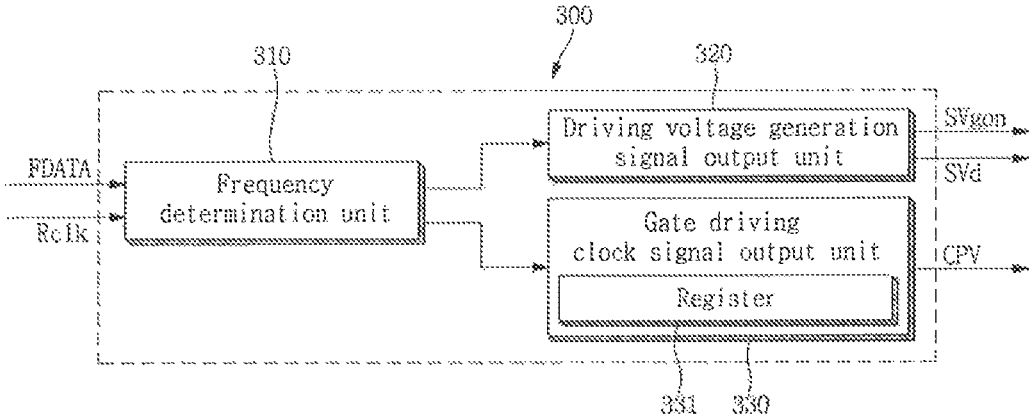
FIG. 3 is a block diagram illustrating a timing controller of FIG. 1 according to an exemplary embodiment of the inventive concept.

FIG. 1 is a block diagram illustrating an LCD device according to an exemplary embodiment of the inventive concept, FIG. 2 is a view schematically illustrating pixels included in a display panel of FIG. 1 according to an exemplary embodiment of the inventive concept, and FIG. 3 is a block diagram illustrating a timing controller of FIG. 1 according to an exemplary embodiment of the inventive concept.

As illustrated in FIG. 1, the LCD device includes a display panel 100, a timing controller 300, a voltage generator 500, a clock generator 400, a gate driver 210, and a data driver 220.

The display panel 100 displays an image. The display panel 100 includes a liquid crystal layer as well as a first substrate and a second substrate facing each other with the liquid crystal layer interposed therebetween.

As illustrated in FIG. 2, the display panel 100 includes a plurality of gate lines GL1 to GLi, a plurality of data lines DL1 to DLj, and a plurality of pixels R, G, and B.

The gate lines GL1 to GLi intersect the data lines DL1 to DLj.

The pixels R, G, and B are arranged along horizontal lines HL1 to HLi. The pixels R, G, and B are connected to the gate lines GL1 to GLi and the data lines DL1 to DLj. For example, there are "j" pixels arranged along an n-th (where $1 \leq n \leq i$) horizontal line (hereinafter, n-th horizontal line pixels), which are connected to the data lines DL1 to DLj. Further, the n-th horizontal line pixels are connected in common to an n-th gate line among the gate lines GL1 to GLi. Accordingly, the n-th horizontal line pixels receive an n-th gate signal as a common signal. In other words, "j" pixels disposed in a same horizontal line receive a same gate signal, while pixels disposed in different horizontal lines receive different gate signals. For example, pixels in a first horizontal line HL1 receive a first gate signal as a common signal, while pixels in a second horizontal line HL2 receive a second gate signal that has a different timing from that of the first gate signal.

Similarly, the pixels R, G, and B are arranged along a plurality of vertical lines. For example, there are "i" pixels arranged along a first vertical line VL1 and these pixels are connected in common to a first data line DL1 among the data lines DL1 to DLj. Accordingly, these pixels receive a first data signal from the first data line DL1.

As illustrated in FIG. 2, each of the pixels R, G, and B includes a thin film transistor TFT, a liquid crystal capacitor Clc, and a storage capacitor Cst.

The TFT is turned on according to a gate signal applied from one of the gate lines GL1 to GLi (e.g., an i-th gate line GLi). The turned-on TFT applies an analog data signal applied from one of the data lines DL1 to DLj (e.g., a j-th data line DLj) to the liquid crystal capacitor Clc and the storage capacitor Cst.

The liquid crystal capacitor Clc includes a pixel electrode and a common electrode which oppose each other.

The storage capacitor Cst includes a pixel electrode and an opposing electrode which oppose each other. Herein, the opposing electrode may be a previous gate line (e.g., GLi−1) or a transmission line for transmitting a common voltage.

Referring back to FIG. 1, the timing controller 300 receives frequency determination data FDATA, an input image data signal DAT, and a reference clock signal Rclk output from a graphic controller provided in a system. An interface circuit is provided between the timing controller 300 and the system, and the signals output from the system are input to the timing controller 300 through the interface circuit. The interface circuit may be embedded in the timing controller 300.

The interface circuit may include an embedded display port ("eDP") receiver or a low voltage differential signaling ("LVDS") receiver. In an exemplary embodiment of the inventive concept, electromagnetic interference (EMI) may occur due to high frequency components of a signal input from the interface circuit to the timing controller 300. To prevent the EMI, an EMI filter may be further provided between the interface circuit and the timing controller 300.

The timing controller 300 outputs a gate driving clock control signal OE, a gate driving clock signal CPV, a scan start signal STV, an image data signal DAT', a data control signal CONT, a gate-on voltage generation signal SVgon, and a data voltage generation signal SVd based on the frequency determination data FDATA, the input image data signal DAT, and the reference clock signal Rclk input thereto. The gate driving clock control signal OE may be a signal for enabling the gate signal, and the scan start signal STV may be a signal for notifying the start of one frame.

In addition, the timing controller 300 rearranges the input image data signal DAT input through the system to output the image data signal DAT' and applies the image data signal DAT' to the data driver 220.

The timing controller 300 is driven by a driving power. For example, the driving power is used as a power voltage of a phase lock loop ("PLL") circuit embedded in the timing controller 300. The PLL circuit compares the reference clock signal Rclk input to the timing controller 300 with a frequency generated from an oscillator. When there is a difference between them, the PLL circuit adjusts the frequency of the reference clock signal Rclk by the difference.

As illustrated in FIG. 3, the timing controller 300 may include a frequency determination unit 310, a driving voltage generation signal output unit 320, and a gate driving clock signal output unit 330.

The frequency determination unit 310 receives the frequency determination data FDATA and the reference clock signal Rclk.

The frequency determination unit 310 may determine a pixel driving clock frequency based on the frequency determination data FDATA.

The frequency determination data FDATA may include a first frequency determination datum and a second frequency determination datum. For example, when receiving a signal through the eDP receiver, the first frequency determination datum and the second frequency determination datum may be values N and M, respectively, for stream clock recovery. In such an exemplary embodiment, the pixel driving clock frequency may be calculated by the following Equation 1.

$$PFREQ = \frac{FDATA1}{FDATA2} \times RFREQ \quad \text{[Equation 1]}$$

In Equation 1, PFREQ denotes the pixel driving clock frequency, FDATA1 denotes the first frequency determination datum, FDATA2 denotes the second frequency determination datum, and RFREQ denotes the frequency of the reference clock signal RCLK.

As shown in Equation 1 above, the pixel driving clock frequency may be calculated and determined based on the frequency determination data FDATA.

The driving voltage generation signal output unit 320 outputs a driving voltage generation signal corresponding to the pixel driving clock frequency. The driving voltage generation signal may include at least one of the gate-on voltage generation signal SVgon and the data voltage generation signal SVd. The driving voltage generation signal output unit 320 may include a lookup table. In the lookup table, the gate-on voltage generation signal SVgon and data voltage generation signal SVd corresponding to the pixel driving clock frequency are stored. The driving voltage generation signal output unit 320 selects the gate-on voltage generation signal SVgon or the data voltage generation signal SVd corresponding to the pixel driving clock frequency from the lookup table, and outputs the selected one of the gate-on voltage generation signal SVgon or the data voltage generation signal SVd. However, the inventive concept is not limited thereto, and the driving voltage generation signal corresponding to the pixel driving clock frequency may be output through various methods.

According to an exemplary embodiment of the inventive concept, the driving voltage generation signal output unit 320 may output the gate-on voltage generation signal SVgon and the data voltage generation signal SVd to provide a higher gate-on voltage Vgon and a higher data voltage Vd, as the pixel driving clock frequency increases. This will be further described below with reference to FIG. 4.

The gate driving clock signal output unit 330 may also include a lookup table, which may be stored in a register 331. Gate driving clock generation data corresponding to the pixel driving clock frequency are stored in the lookup table. The gate driving clock signal output unit 330 selects a gate driving clock generation datum corresponding to the pixel driving clock frequency from the lookup table and generates the gate driving clock signal CPV based on the selected gate driving clock generation datum.

In an exemplary embodiment of the inventive concept, the gate driving clock generation data stored in the lookup table and corresponding to the pixel driving clock frequency may be changed by a user. Accordingly, the gate driving clock signal CPV may be generated by the user.

Referring back to FIG. 1, the timing controller 300 generates and outputs the image data signal DAT' and the data control signal CONT. The data control signal CONT includes a source start pulse, a source shift clock, a source output enable signal, a polarity signal, or the like.

The voltage generator 500 generates voltages necessary for the display panel 100 by boosting or lowering a driving voltage input through the system. To this end, the voltage generator 500 may include, for example, an output switching element for switching an output voltage of an output terminal thereof and a pulse width modulator PWM for boosting or lowering the output voltage by controlling a duty ratio or a frequency of a control signal input to a control terminal of the output switching element, e.g., the gate-on voltage Vgon and a gate-off voltage Vgoff. Alternatively, a pulse frequency modulator PFM may be included in the voltage generator 500 instead of the pulse width modulator PWM described above.

The pulse width modulator PWM may increase the duty ratio of the aforementioned control signal to increase the output voltage of the voltage generator 500 or decrease the duty ratio of the control signal to lower the output voltage of the voltage generator 500. The pulse frequency modulator PFM may increase the frequency of the aforementioned control signal to increase the output voltage of the voltage generator 500 or decrease the frequency of the control signal to lower the output voltage of the voltage generator 500.

The voltage generator 500, according to an exemplary embodiment of the inventive concept, receives the driving voltage generation signal corresponding to the pixel driving clock frequency. As described above, the driving voltage generation signal may be at least one of the gate-on voltage generation signal SVgon and the data voltage generation signal SVd. The voltage generator 500 outputs the gate-on voltage Vgon, the gate-off voltage Vgoff, and the data voltage Vd according to the received driving voltage generation signal. In the case where the gate-on voltage generation signal SVgon is input to the voltage generator 500, the gate-on voltage Vgon may be boosted or lowered, and in the case where the data voltage generation signal SVd is input to the voltage generator 500, the data voltage Vd may be boosted or lowered. As the pixel driving clock frequency increases, the driving voltage increases, where the driving voltage may be at least one of the gate-on voltage Vgon and the data voltage Vd.

The gate-on voltage Vgon is a high logic voltage of the gate signal, which is set to be greater than or equal to a threshold voltage of a switching element provided in a pixel. The gate-off voltage Vgoff is a low logic voltage of the gate signal, which is set to be an off voltage of the switching element.

The voltage generator 500 may output a gamma reference voltage and a common voltage. The gamma reference voltage is a voltage generated by voltage division of the data voltage Vd. The data voltage Vd and the gamma reference voltage are analog gamma voltages and they are applied to the data driver 220. The common voltage is provided to the common electrode of the display panel 100 through the data driver 220.

The clock generator 400 receives the gate driving clock control signal OE, the gate driving clock signal CPV, and the scan start signal STV output from the timing controller 300, and receives the gate-on voltage Vgon and gate-off voltage Vgoff output from the voltage generator 500.

According to an exemplary embodiment of the inventive concept, the clock generator 400 generates and outputs a converted gate driving clock signal CKV and the gate-on voltage Vgon corresponding to the gate driving clock control signal OE, the gate driving clock signal CPV, and the scan start signal STV, based on the gate-on voltage Vgon and the gate-off voltage Vgoff. In such an exemplary embodiment, the converted gate driving clock signal CKV is a signal reflecting the gate-on voltage Vgon on the gate driving clock signal CPV. In addition, the clock generator 400 converts the scan start signal STV into a converted scan start signal STVP and outputs the converted scan start signal STVP. The converted scan start signal STVP is a signal obtained by increasing an amplitude of the scan start signal STV.

The gate driver 210 generates gate signals according to the converted scan start signal STVP, the converted gate driving clock signal CKV, and the gate-on voltage Vgon output from the clock generator 400, and sequentially applies the gate signals to the plurality of gate lines GL1 to GLi. For example, the gate driver 210 is enabled by the converted scan start signal STVP to generate the plurality of gate signals based on the converted gate driving clock signal CKV and the gate-on voltage Vgon. The gate driver 210 sequentially outputs the gate signals to the plurality of gate lines GL1 to GLi.

The gate driver 210 may include, for example, a shift register. The shift register may include a plurality of driving switching elements. The driving switching elements are formed in a non-display area of the display panel 100. The driving switching elements may be formed in substantially the same process as that of the switching element of the pixels R, G, and B.

The data driver 220 receives the image data signal DAT' and the data control signal CONT from the timing controller 300. The data driver 220 samples the image data signal DAT' according to the data control signal CONT, latches the sampled data signals corresponding to one horizontal line in each horizontal period, and applies the latched image data signals to the data lines DL1 to DLj. For example, the data driver 220 converts the image data signal DAT' from the timing controller 300 into analog image data signals using the gamma reference voltages input from the voltage generator 500, and applies the analog image data signals to the data lines DL1 to DLj.

Figure 4:
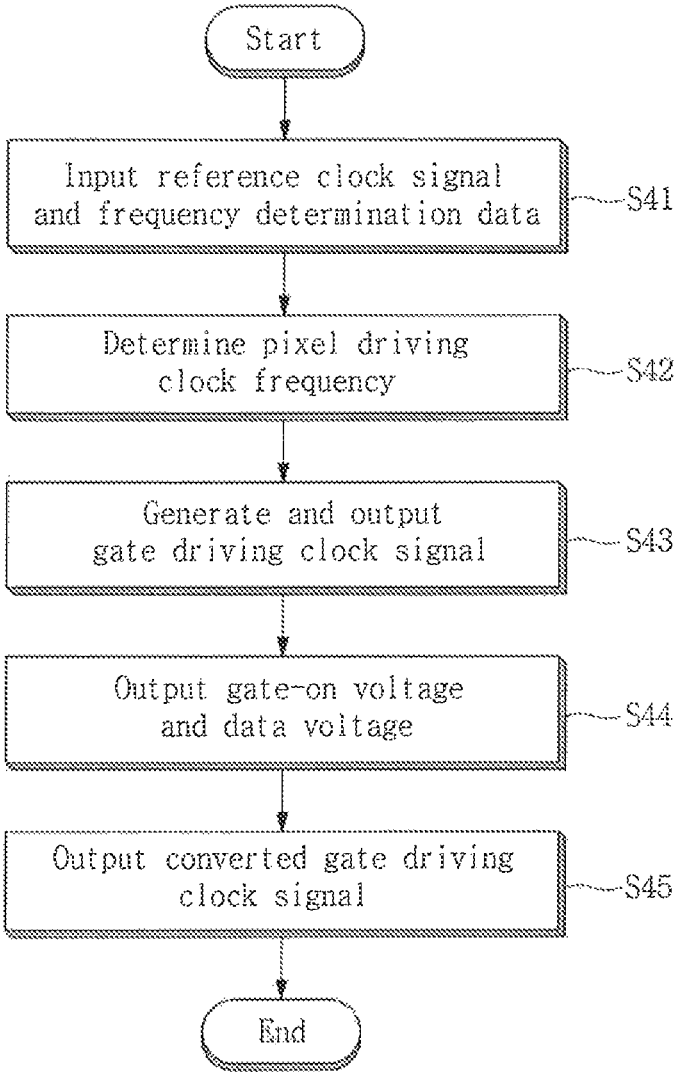
FIG. 4 is a flowchart illustrating a driving method according to an exemplary embodiment of the inventive concept.

FIG. 4 is a flowchart illustrating a driving method according to an exemplary embodiment of the inventive concept.

The timing controller 300 receives the reference clock signal Rclk and the frequency determination data FDATA (S41). The pixel driving clock frequency is determined based on the frequency determination data FDATA (S42). Since the frequency determination data FDATA has different values depending on the frequency for driving the display device, the pixel driving clock frequency may be determined based on the frequency determination data FDATA.

The timing controller 300 selects a gate driving clock generation datum corresponding to the pixel driving clock frequency from the lookup table therein, and generates and outputs the gate driving clock signal CPV based on the selected gate driving clock generation datum (S43). In an exemplary embodiment of the inventive concept, the gate driving clock generation data stored in the lookup table may be changed by a user.

The voltage generator 500 outputs the gate-on voltage Vgon and the data voltage Vd corresponding to the pixel driving clock frequency (S44). According to an exemplary embodiment of the inventive concept, as the pixel driving clock frequency increases, the gate-on voltage Vgon and the data voltage Vd may have larger values. Accordingly, a charging rate of liquid crystals may be increased in the display device.

The clock generator 400 outputs the converted gate driving clock signal CKV which is a signal reflecting the increased gate-on voltage Vgon on the gate driving clock signal CPV (S45).

Figure 5A:
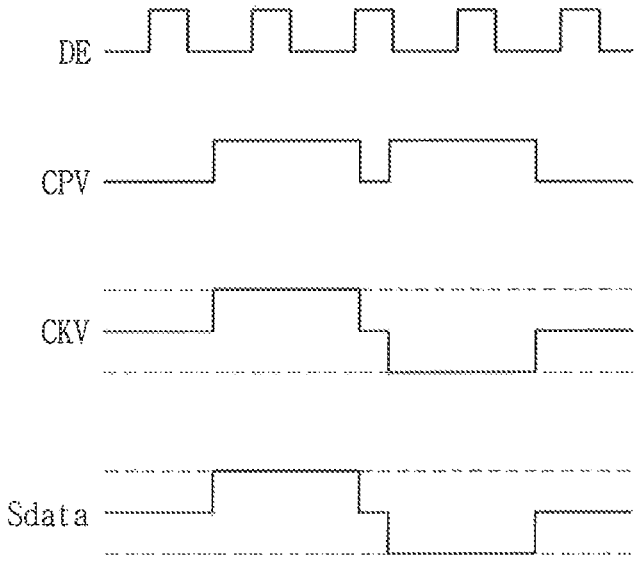
FIGS. 5A and 5B are driving timing diagrams according to an exemplary embodiment of the inventive concept.
Figure 5B:
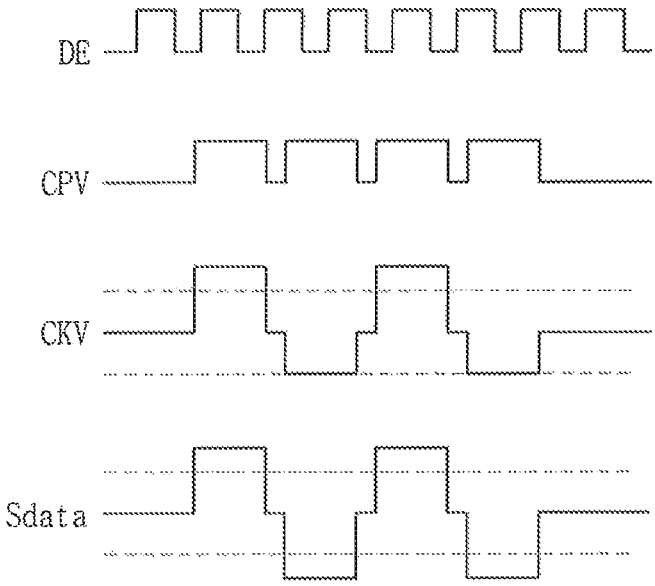
Figure 6A:
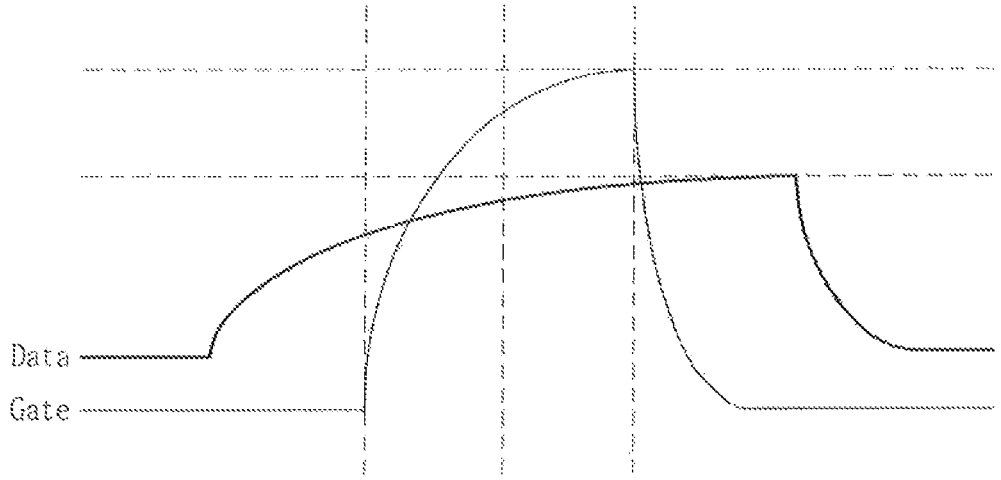
FIGS. 6A and 6B are driving waveform diagrams according to an exemplary embodiment of the inventive concept.
Figure 6B:
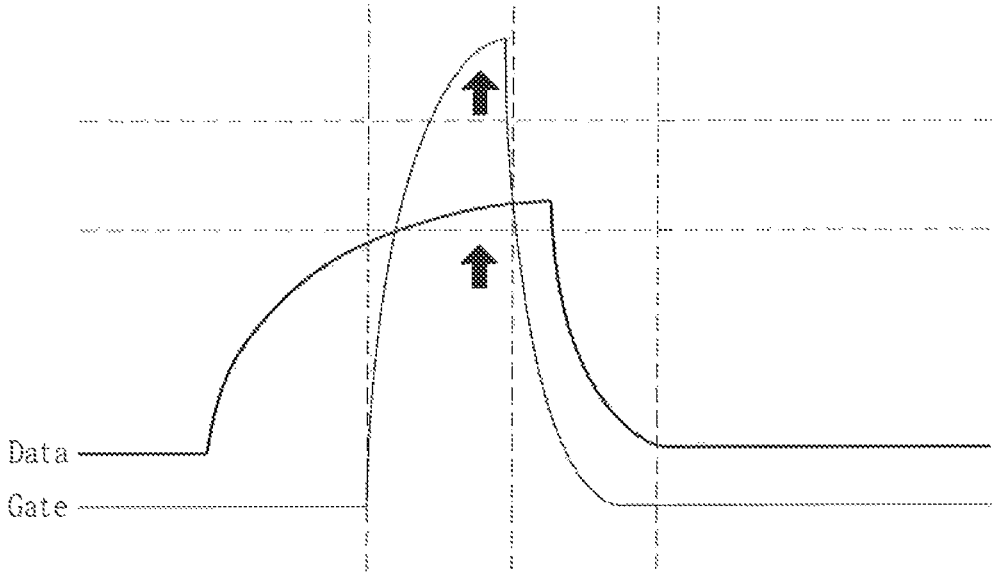

FIGS. 5A and 5B are driving timing diagrams according to an exemplary embodiment of the inventive concept, and FIGS. 6A and 6B are driving waveform diagrams according to an exemplary embodiment of the inventive concept.

FIG. 5A is a driving timing diagram of a display device driven at A MHz, and FIG. 5B is a driving timing diagram of a display device driven at B MHz, as shown by a data enable signal DE. FIG. 6A is a view illustrating waveforms of a gate signal and a data signal of a display device driven at A MHz, and FIG. 6B is a view illustrating waveforms of a gate signal and a data signal of a display device driven at B MHz. In these examples, B is larger than A. In other words, the display device in FIGS. 5B and 6B is driven at a higher frequency than that of FIGS. 5A and 6A.

As illustrated in FIGS. 5A and 5B, the gate driving clock signal CPV, the converted gate driving clock signal CKV, and a data signal Sdata have a higher frequency when the driving frequency is higher, e.g., frequencies are higher in FIG. 5B as compared to FIG. 5A.

As illustrated in FIGS. 5A and 5B, in the case where the display device is driven at a higher frequency (e.g., in FIG. 5B), the gate-on voltage Vgon and the data voltage Vd increase, and thus, amplitudes of the converted gate driving clock signal CKV and the data signal Sdata, which are signals reflecting the gate-on voltage Vgon, also increase. Accordingly, as illustrated in FIGS. 6A and 6B, in the case where the display device is driven at a higher frequency (e.g., in FIG. 6B), amplitudes of the gate voltage and the data voltage increase and a charging rate of liquid crystals may be increased in the display device.

As set forth hereinabove, according to exemplary embodiments of inventive concept, a method of driving the LCD device may provide the following effects. The gate signal may be normally output even when the frequency for driving the LCD device varies. In addition, in the case where the frequency for driving the LCD device increases such that the charging rate of the pixel electrode is insufficient, the charging rate of the pixel electrode may be compensated by increasing the gate-on voltage and the data voltage.

While the inventive concept has been illustrated and described with reference to exemplary embodiments thereof, it will be apparent to those of ordinary skill in the art that various changes in form and details may be made thereto without departing from the spirit and scope of the inventive concept as set forth in the following claims.

What is claimed is:

1. A method of driving a display device, the method comprising:

receiving a reference clock signal and frequency determination data to determine a pixel driving clock frequency and generate a pixel driving clock signal;

generating and outputting a gate driving clock signal according to the pixel driving clock frequency; and outputting a driving voltage according to the pixel driving clock frequency, wherein the driving voltage increases as the pixel driving clock frequency increases.

2. The method of claim 1, wherein the driving voltage is at least one of a gate-on voltage and a data voltage.

3. The method of claim 1, wherein generating and outputting the gate driving clock signal comprises:

selecting a gate driving clock generation datum according to the pixel driving clock frequency; and generating and outputting the gate driving clock signal according to the gate driving clock generation datum.

4. The method of claim 3, wherein the gate driving clock generation datum is changeable by a user.

5. The method of claim 1, wherein the frequency determination data comprises a first frequency determination datum and a second frequency determination datum.

6. The method of claim 5, wherein receiving the reference clock signal and the frequency determination data to determine the pixel driving clock frequency and generate the pixel driving clock signal further comprises:

calculating the pixel driving clock frequency.

7. The method of claim 6, wherein the pixel driving clock frequency satisfies the following Equation 1:

$$PFREQ = \frac{FDATA1}{FDATA2} \times RFREQ, \quad \text{[Equation 1]}$$

wherein PFREQ is the pixel driving clock frequency, FDATA1 is the first frequency determination datum, FDATA2 is the second frequency determination datum, and RFREQ is a frequency of the reference clock signal.

8. The method of claim 1, wherein the gate driving clock signal has a frequency different from a frequency of the reference clock signal.

9. A display device comprising:

a display panel;

a timing controller configured to receive a reference clock signal and frequency determination data, determine a pixel driving clock frequency and generate a pixel driving clock signal;

a clock generator configured to generate and output a gate driving clock signal according to the pixel driving clock frequency; and a voltage generator configured to output a driving voltage according to the pixel driving clock frequency, wherein the driving voltage increases as the pixel driving clock frequency increases.

10. The display device of claim 9, wherein the timing controller determines the pixel driving clock frequency using the reference clock signal and the frequency determination data.

11. The display device of claim 10, wherein the pixel driving clock frequency satisfies the following Equation 1:

$$PFREQ = \frac{FDATA1}{FDATA2} \times RFREQ, \quad \text{[Equation 1]}$$

wherein PFREQ is the pixel driving clock frequency, FDATA1 is a first frequency determination datum of the frequency determination data, FDATA2 is a second frequency determination datum of the frequency determination data, and RFREQ is a frequency of the reference clock signal.

12. The display device of claim 9, wherein the timing controller is configured to output a driving voltage generation signal, and the driving voltage generation signal is one of a gate-on voltage generation signal and a data voltage generation signal.

13. The display device of claim 10, wherein the driving voltage is one of a gate-on voltage and a data voltage.

14. The display device of claim 13, wherein the gate-on voltage and the data voltage increase as the pixel driving clock frequency increases.

15. A display device comprising:

a display panel;

a timing controller configured to receive a reference clock signal and frequency determination data, determine a pixel driving clock frequency using the reference clock signal and the frequency determination data, and output a driving voltage generation signal and a gate driving clock signal corresponding to the pixel driving clock frequency;

a voltage generator configured to receive the driving voltage generation signal to output a gate-on voltage and a data voltage;

a clock generator configured to receive the gate driving clock signal and the gate-on voltage to output a converted gate driving clock signal;

a data driver configured to receive the data voltage and output a data signal to the display panel; and a gate driver configured to receive the converted gate driving clock signal and gate-on voltage, and output a gate signal to the display panel, wherein as the pixel driving clock frequency increases, at least one of the gate-on voltage and the data voltage increases.

16. The display device of claim 15, wherein the timing controller comprises:

a frequency determination unit configured to receive the reference clock signal and the frequency determination data and determine the pixel driving clock frequency, wherein the pixel driving clock frequency satisfies the following Equation 1:

$$PFREQ = \frac{FDATA1}{FDATA2} \times RFREQ, \quad \text{[Equation 1]}$$

wherein PFREQ is the pixel driving clock frequency, FDATA1 is a first frequency determination datum of the frequency determination data, FDATA2 is a second frequency determination datum of the frequency determination data, and RFREQ is a frequency of the reference clock signal.

17. The display device of claim 15, wherein the timing controller comprises:

a driving voltage generation signal output unit including a lookup table, wherein the driving voltage generation signal output unit selects the driving voltage generation signal corresponding to the pixel driving clock frequency using the lookup table.

18. The display device of claim 15, wherein the driving voltage generation signal is one of a gate-on voltage generation signal and a data voltage generation signal, the voltage generator adjusts the gate-on voltage when the driving voltage generation signal is the gate-on voltage generation signal, and the voltage generator adjusts the data voltage when the driving voltage generation signal is the data voltage generation signal.

19. The display device of claim 18, wherein the voltage generator includes one of a pulse width modulator or a pulse frequency modulator to adjust the gate-on voltage or the data voltage.

20. The display device of claim 15, wherein the converted gate driving clock signal is a signal reflecting the gate-on voltage on the gate driving clock signal.

* * * * *